United States Patent [19]

Blaul

[11] Patent Number: 4,886,081

[45] Date of Patent: Dec. 12, 1989

[54] METHOD OF IMPACT CLEANING WITH SOLVENT SPRAY IN AN ENCLOSED CHAMBER

[75] Inventor: Ronald L. Blaul, Crystal Lake, Ill.

[73] Assignee: Trigent, Inc., McHenry, Ill.

[21] Appl. No.: 33,784

[22] Filed: Apr. 3, 1987

Related U.S. Application Data

[60] Division of Ser. No. 731,728, May 8, 1985, Pat. No. 4,676,261, which is a continuation-in-part of Ser. No. 672,145, Nov. 16, 1984, Pat. No. 4,561,903, which is a continuation of Ser. No. 410,589, Aug. 23, 1982, abandoned, which is a division of Ser. No. 275,965, Jun. 22, 1981, Pat. No. 4,433,698.

[51] Int. Cl.[4] ..... B08B 3/02

[52] U.S. Cl. ..... 134/18; 134/19; 134/104; 134/111; 134/200; 134/57 R

[58] Field of Search ..... 134/10, 18, 104, 111, 134/200, 201, 58 R, 57 R, 105, 175, 177, 198, 19; 55/385 R

[56] References Cited

U.S. PATENT DOCUMENTS

| | | | |
|---|---|---|---|
| 2,208,646 | 7/1940 | Saunders et al. | 134/104 X |
| 3,416,544 | 12/1968 | Paiva | 134/200 X |
| 3,971,394 | 7/1976 | Osborne | 134/111 |
| 4,038,155 | 7/1977 | Reber | 134/200 X |
| 4,101,340 | 7/1978 | Rand | 134/109 X |

*Primary Examiner*—Harvey C. Hornsby
*Assistant Examiner*—Frankie L. Stinson
*Attorney, Agent, or Firm*—John W. Gaines

[57] ABSTRACT

Method of solvent spray impact cleaning utilizing a hand directed pump nozzle for impact spraying of parts, by eye through a viewing window, and an enclosing chamber containing the parts in a manner whereby the zone for solvent spray by the pump nozzle is closely confined within the enclosure so as not to expose the operator or the outside environment to the liquid runoff of the solvent, or to the sprayed particles thereof, or to solvent steam or vapors rising at the spraying temperature. The internal air of the chamber and all solvent are continually recycled electrically by blower and pump for re-use after the latter, once in an operative status, are then activated according to the washing procedure. The recycled air re-enters through a blower nozzle directed so that it clears the window. Automatically, sensed immediately the chamber is opened to exchange parts, the blower and pump nozzles are disabled from their operative status through internal confinement of the circulated air and liquid by preventing circulation entirely.

11 Claims, 3 Drawing Sheets

W
P

METHOD OF IMPACT CLEANING WITH SOLVENT SPRAY IN AN ENCLOSED CHAMBER

This application is a divisional of Ser. No. of 731,728 filed May 8, 1985 now U.S. Pat. No. 4,676,903 which is a continuation-in-part of Ser. No. 672,145 filed Nov. 16, 1984, now U.S. Pat. No. 4,561,903 itself a continuing application of Ser. No. 410,589 filed Aug. 23, 1982, now abandoned which is a divisional of Ser. No. 275,965 filed June 22, 1981 now U.S. Pat. No. 4,433,698.

The invention hereof relates to spray impact cleaning employing a high pressure liquid spray of solvent. Spray impact at the spraying temperature causes vaporizing and fogging which rise in the air from the cleaning fluids.

It relates more particularly to impact washing, by eye through a viewing window, of parts under high pressure by means of a hand directed spray nozzle, and an enclosing chamber containing the parts in a manner whereby the spraying zone in which the parts are sprayed by the nozzle is closely confined within the enclosure so as not to expose the operator or the outside environment to the liquid runoff of the solvent, or to the sprayed particles thereof, or to solvent steam or rising vapors. The internal atmosphere of the chamber is restricted thereby to its same closed confines as the spraying zone, such that preventing escape of both atmosphere and solvent enables recovery of all of the air and all of the solvent so as to be continually recycled and re-used, without being lost to some extent to the outside and, undesirably so, introducing thereto contamination to that extent. Such desiderata entail, as will be seen according to the practice of my invention, simultaneously keeping down the vapor concentration by defogging the chamber air, defogging the viewing window through blanketing same by the defogged air as recirculated, keeping clean and strong the solvent by its recycling as recirculated, and disabling all circulation of the fluids so no flow of air or solvent can be run when the chamber is open to exchange parts therein.

Washing methods in accordance with practice in the past have, for instance, involved such machines as are utilized by the repair man who frequently washes parts, an automobile mechanic, for example, and they provide an open front for his ready accessibility with his washing, also a hand brush, and a slow running, steady, solid, large stream usually of a petroleum solvent with which he rinses off a part after brushing, if necessary. The rinse-off is manual, accomplished by directing a hose-carried hand nzzle provided on the parts washer, and the rinse solvent is continually filtered and admitted to a pump on the machine for constant re-use by being recirculated back to the hand nozzle. By reason of convenience and expediency, it is therefore the practice for the repair man to wash parts openly in the washer and usually bare-handed, and in no way protecting his skin surfaces, clothing, and breathing from the drawback of direct exposure to solvent stream, splash, and air-borne fumes, and in no way protecting outside surroundings to the washer from that same drawback.

It is an object of the present parts washing invention to materially reduce or substantially eliminate the foregoing drawback, and other disadvantages of parts washing as just described. Of lesser analogy to this washing procedure for the repair man, some background patents which can be noted include, along with the publication Abstract Number PCT/CH80/00029 priority date 3/26/79 published 10/2/80 disclosing a washer for hands with air recirculation of relevance, a certain U.S. Pat. No. 4,170,488 disclosing a continuous parts washer with cleaner and air recycling of relevance, and U.S. Pat. No. 3,857,002 entitled "Safety Mechanism for Laundry Appliances with Door Latch for Actuating Main Switch." More especially to be noted are the two U.S. Pats. Gladfelter No. 2,576,008 disclosing a glass-fronted sluriator with glove box gloves, a blast gun nozzle, and an exhaust blower of relevance, and Rand No. 4,101,340 disclosing a nail degreaser and drier chamber with air exhausting in part in its path by blowing directly out into the atmosphere and flowing in part in an air recirculation path of relevance.

Another object, so as to defog for the purpose stated, is to provide a blower-recirculated atmosphere recycling circuit effective to limit and dilute the vapor to a reduced concentration by vapor-to-liquid agglomeration thereof in the filter provided and by reintroduction of the vapor-ridded air, when recycled, for continued circulation within the closed confines of the spray chamber.

An additional object, in giving the solvent a closed cycle path for the required cleaning as noted, lies in the provision of a pump-forced path of recirculation for recycling all solvent runoff as ultimately rejoined by the air filter's agglomerate mentioned in the immediately preceding objective.

A further object, toward the end of achieving the preceding objective of the blower-recirculated atmosphere recycling circuit, is to provide a blower ductwork containing an air-forcing blower, and having an inlet and outlet arranged with the filter in the inlet; a blower nozzle provided in the outlet and a viewing window for the chamber establish cooperation to aid the eye of the mechanic by the nozzle directing the forced-pressure re-introduced, de-saturated recycled air in a path sweeping across the window on its inside surface, to prevent fogging from any solvent vapor which might otherwise deposit itself across the area of transparency.

Another object is provision in the invention for an arrangement of discriminating switching responding only to a sensed open condition of the spraying chamber and connected only to electric blower and pump motors provided for the air and liquid recirculation. So, far from any identification as having direct shut-down switching, the machine is afforded the capability with the cabinet open or closed to have sustained electric lighting therewithin and, at all times of idleness of the liquid pumping motor, to electrically heat the liquid as in machine warmup and then keep it up to washing temperature. Yet contemporaneously, without exception the circulation of fluids is so controlled that nothing escapes during parts' washing or during subsequent interruptions for parts' exchange for the clean ones. So no area in the shop is contaminated or steamed up by vapors of mineral solvent detergent or steam-off from water solution detergent.

It is an additional object, in the case of simple multipole and single-pole and multi-throw and single-throw switches, to utilize them in effective combinations of circuitry in the switching arrangement necessary. And in another case to just as effectively include normally closed and transfer contacts and an operating relay therefor controlling circuits in the switching arrangement employed.

Further features, objects, and advantages will either be specifically pointed out or become apparent when, for a better understanding of my invention, reference is made to the following description taken in conjunction with the accompanying drawings which show certain preferred embodiments thereof and in which.

Figures 1, 2, 3, 5, 6:
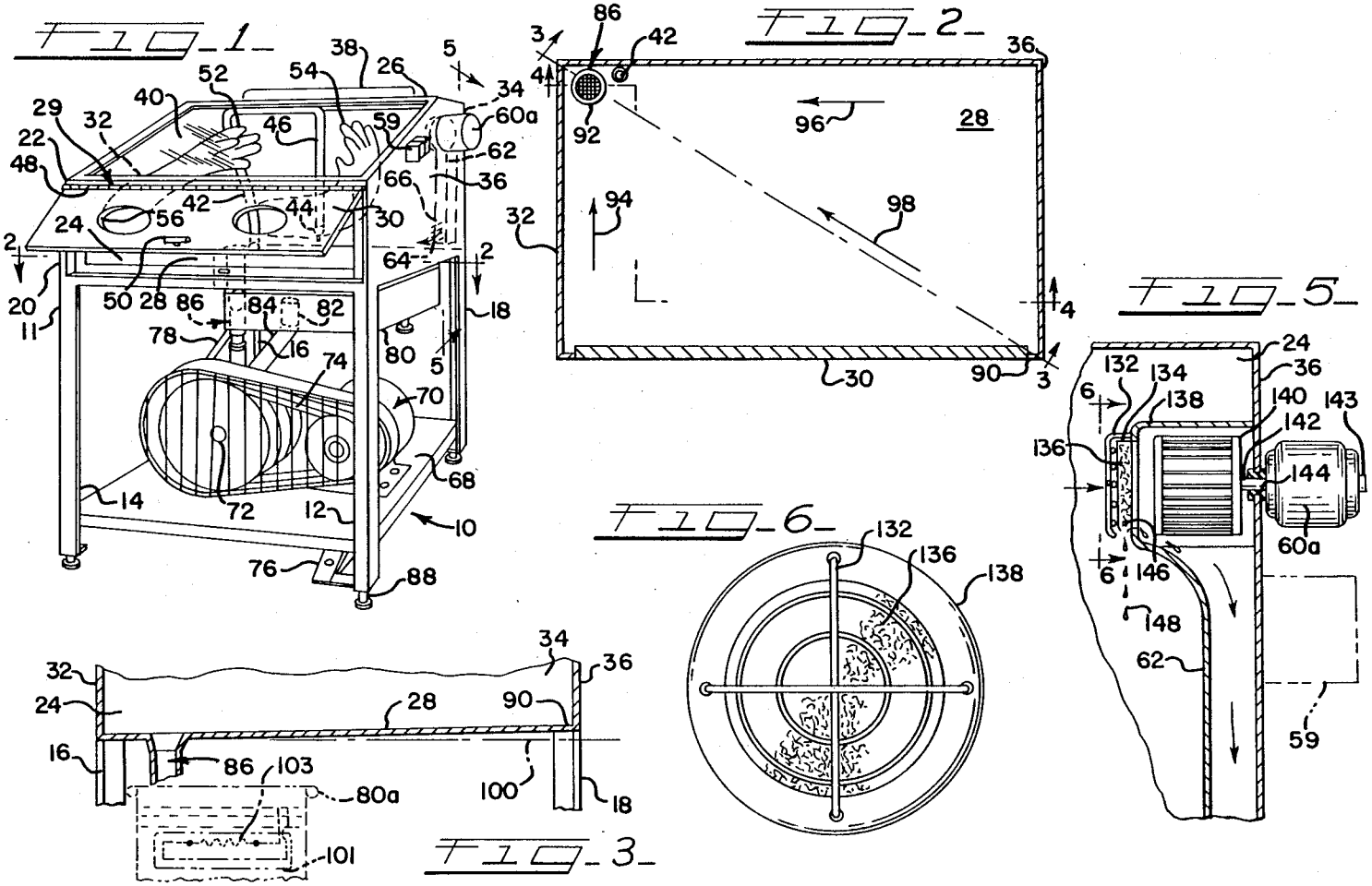
FIG. 1 is an isometric view of the washer as fully assembled, with a floor stand therefor and a cleaning machine atop the stand and embodying the blower ductwork thereof and other principles of the present invention.
FIG. 2 is a section, in plan view, of the machine's floor pan as taken along the section line 2—2 of FIG. 1.
Figures 4, 7, 8, 9:
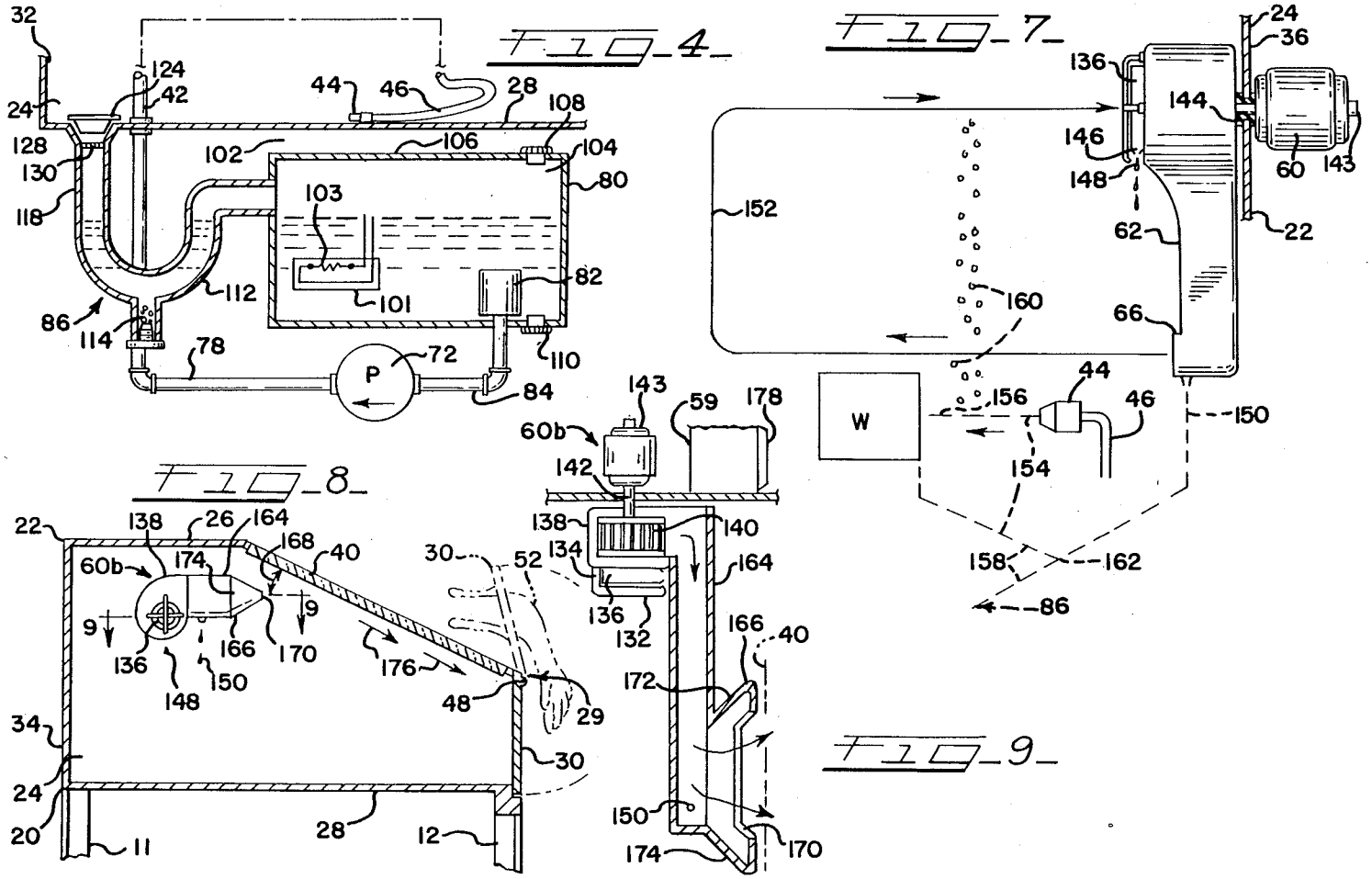
Figure 11:
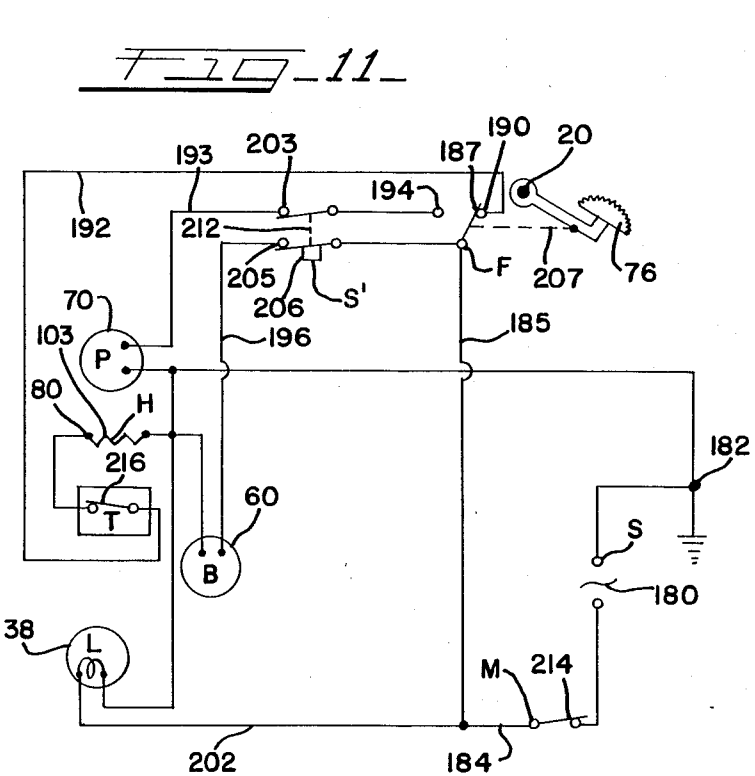
Figure 10:
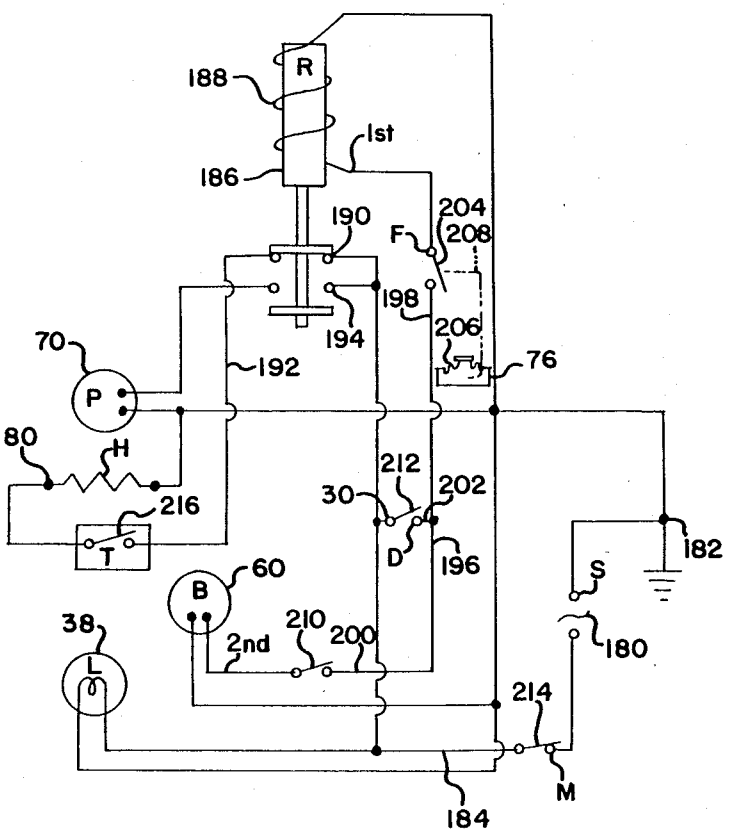

FIGS. 3 and 4 are cross sectional views in front elevation of the floor pan as taken along the section lines 3—3 and 4—4, respectively, of FIG. 2;

FIG. 5 is a cross sectional, front elevational detail showing the blower ductwork in vertical disposition and taken along the section line 5—5 of FIG. 1;

FIG. 6 is an elevational face view of the inlet filter carried by the blower ductwork inlet, as viewed in the direction indicated by the section line arrows 6—6 in FIG. 5;

FIG. 7 is similar to FIG. 5, but is further supplemented with schematic additions indicating solvent spray crossover joining the closed path of circulation of air by the blower ductwork, and indicating agglomerate crossover joining the closed path of pumped solvent circulation as soon as the air path loses its entrained vapor being filtered out and agglomerated in the air ductwork;

FIG. 8 is similar to FIG. 6, additionally thereto showing a near-horizontal ductwork modification of the invention in more complete detail and being supplemented for further details by FIG. 9 as taken along the diagonally-run cross sectional lines 9—9 in FIG. 8;

FIG. 10 is an electrical schematic showing of the automatic power control circuitry coordinating the two recycling systems provided in the machine; and FIG. 11 is an electrical schematic diagram showing a modification of the FIG. 10 circuitry.

More particularly in the drawings, a hot tank spray washer 10 is shown in FIG. 1 having a floor stand 11 supported on four legs 12, 14, 16, and 18 and supporting the machine 20 for cleaning parts. The machine has a six-sided, vapor confining cabinet 22 affording a fully enclosed spray chamber 24 therein and including, along with the spaced apart sealed top wall 26 which is relatively foreshortened and floor pan wall 28 therebeneath, a continuous series of side walls 29, 32, 34, and 36 joining same for totally confining the air contents contained by the chamber 24.

The top wall has structure including a light fixture 38 equipped with one or so straight fluorescent lamp tubes for clear view by the operator of work in the chamber 24. In that connection, what I provide at the front side actually consists respectively of pivotally-joined vertical lower and glassed, diagonally disposed, upper panels together forming the front side wall 29 in extent, respectively upright transversely to the adjacent floor pan 28 and slanting upwardly and rearwardly to a point of attachment between the top end of the diagonal upper front panel and the relatively foreshortened top wall 26.

Specifically, the lower panel of the front side wall 29 is formed mainly by a sealed door 30 secured by a horizontally disposed piano hinge 48 at the top edge so as to open outwardly and upwardly to admit work through the door opening in the panel into the chamber 24. A transparent plastic window 40 of Plexiglas or ¼" safety glass is inset at a console viewing angle in parallel in the diagonal upper front panel of the front side wall 29.

A high pressure hose 42 which passes through the chamber 24 is secured inside the cabinet 22 so as to hang down at or near the center of the underside of the foreshortened top wall 26 and supplies a spray nozzle 44 carried at a free swinging, depending terminal portion of the hose 42.

One or more door handles 50 at the front of the door 30 control a lock carried by the door to keep it tight against door edge seals when the door closes. Omitted from appearing are the door seals because of the small scale of the showing, and a sealed door switch hereinafter referred to is not shown for the same reason, the seals and switch being standard ones with moisture resistance.

Left and right, leak-proof glove box gloves 52 and 54 are in the chamber sealed to the inside of hand holes 56 and 58 in the door, allowing the operator access for his hands and forearms into the chamber 24 at a point below the viewing window 40. The operator stays dry because of the door and because of the impervious arm-length work gloves 52 and 54, he being afforded no alternative to wearing the protective gloves.

The side wall 36 which is at the right end of the cabinet 22 as viewed in FIG. 1 carries adjacent one another an attached power control box 59 on the outside and also an electric blower generally indicated at 60*a*. The outlet of the blower has, on the inside starting at the top of the cabinet, a vertically disposed run of conduit 62 constituting the blower ductwork, and the ductwork affords continuous internal circulation of the chamber atmosphere. Specifically, it reintroduces the atmosphere by discharging at the bottom into the chamber downwardly and at right angles through a vaned blower nozzle 64 in the blower output communicatively transverse to the tower and medially directed as part of the air circuit desired.

The stand legs 12, 14, 16, and 18 support, at a slight distance above the floor, a generally horizontal base platform 68. The platform 68 has bolted thereto a switch-operated electric pump 70 having the high pressure pumping component 72 thereof connected by shaft or by a V-belt 74 as illustrated to its drive motor. The drive motor is operated through a pneumatically actuated drive switch by a remote air capsule pedal 76 reposing on the floor, which frees the hands of the operator by affording him foot control to start and stop initiation of the spray cleaning operation.

More specifically, a high pressure conduit of the pumping component 72 connects the pump output with a hose fitting to the spray nozzle hose 42 positioned in chamber 24. After the operator directs a nozzle 44 on the hose at a part to be cleaned, he presses his foot down on the pedal 76, and the nozzle 44 pressurizes and starts spraying.

In the upper part of the floor stand 11, a hot reservoir tank 80 is carried on a level spaced at all points a predetermined safe distance below the bottom of the floor pan wall 28 which serves in closing off the bottom of the chamber 24. From a filter supported within the tank 80, an interconnecting suction conduit 84 leads to the inlet side of the pumping component 72.

Suitable drain line structure 86 interconnects the hot tank 80 and the floor pan wall 28 for handling drainage in the way it collects in the latter. Each of the legs on the stand 11, such as the right front leg 12 which is typical, stands on a threadedly adjustable foot 88. In installation, the foot 88 is threadedly extended to make the leg 12 slightly longer than a pair of legs 14 and 18 of matching lengths, whereas the left rear leg is adjusted to become the shortest, all solidly on a level floor.

FLOOR PAN DRAINAGE—FIGS. 2, 3

The unequal leg adjustment beneath the floor stand 11, just described but hardly perceptible to the eye, produces a definite slope in the floor pan from a high point at the right front corner 90 down to the low point 92 connected to drain structure 86. The true horizontal plane appears at 100 in FIG. 3.

So gravity directed runoff all converges toward and is collected by the single drain, all without allowing runoff to puddle or otherwise accumulate before going directly down the drain.

A reservoir pail 80*a*, shown in FIG. 3 without the attendant cover necessary, schematically appears in phantom to represent the electric hot tank and includes therein a sealed heater 101 immersed in the tank liquid and containing an electrical resistor element 103. As so embodied, the pail 80*a* accommodates to a straight vertical drain pipe. For a quick change of fluid, the minor effort involved is simply to lift off the pail cover, remove the pail, dispose of spent fluid, refill with a fresh water-mix of powdered detergent, for example, and replace the cover.

FORCED LIQUID CIRCULATION—FIG. 4

In their locations on opposite vertical sides of the air space 102 by which they are kept forcibly separated, the chamber 24 at the bottom is maintained sealed apart by the wall 28 and the reservoir chamber 104 at the top is maintained sealed apart by the impervious reservoir cover 106. A fill opening cap 108 tightly closes off a fill opening in the cover and a drain plug 110 tightly closes off a drain opening in the bottom wall of the reservoir tank 80. The liquid-proof tank heater 101 with its resistor coil 103 therein is shown down in the liquid of the tank.

In one preferred embodiment of the structure 86, a drain trap 112 is provided therefor of familiar plumbing U-shape; in the usual way, the legs of the trap hold it continually full of liquid. At the lowest point in the bend therein, the trap 112 has a depending vertical extension 114 which, when unplugged as provided for at the bottom, allows metal chips and an accumulation of grit and other particles which sink down out of the liquid to be periodically removed from the liquid system. A strainer cup is illustrated at 124.

All liquid which the pump 72 causes to be discharged by the nozzle 44 eventually makes its way back from the chamber 24, thence through the drain structure 86, and into storage in the tank 80 so as to be again available for the electric pump 72. A throat strainer is shown at 130.

FORCED INTERNAL ATMOSPHERE CIRCULATION—FIGS. 5, 6

A wire grille 132 covers the inlet 134 to the tower 62 which, on the inlet's outer side, carries a liquid agglomerating filter 136 behind the grille 132 and which, on the inlet's inner side, carries the communicating tower scroll housing 138 containing the blower rotor cage 140. A motor shaft 142 passing from a blower motor 143 through a shaft seal 144 in wall 36 supports the blower cage 140 for high speed rotation causing the internal atmosphere of the spray chamber to be drawn through the filter 136 in the direction indicated by a suction arrow. The blower cage then forces the air to blow down the tower 62 in the vertical direction of the arrows shown therein.

Cleaning-liquid fog is extracted from the chamber's internal atmosphere by the agglomerating filter 136. A good part of the thus separated liquid in the filter agglomerates as droplets or drops in a drip hole 146 at the bottom of the filter 136 so as to fall in the chamber in a side path it takes which I indicate generally at 148 and which I shall designate the 2d crossover path.

The remainder of the agglomerate spills out the face of the filter 136 on the inner side so as to go down the inside of the blower tower 62 in a 3d crossover path generally indicated at 150, either by free fall as drops or droplets or by dripping or running down along the inside wall of the tower and out through a drip hole.

CROSSOVER—FIG. 7

Although the just preceding discussion of air-blower forced circulation was presented separately and independently from a prior appearing discussion of the pump forced liquid circulation, the stringently confined paths of these two closed circulation systems establish cooperation and have three common portions contained within the confines of the spray chamber 24. The essentially air-tight integrity of the surrounding cabinet fragmentarily shown in FIG. 7 at 22 will insure a leak-free internal air path schematically indicated at 152 and a leak-free liquid path schematically fragmentarily indicated at 154.

High pressure pump spray 156 along path 154 can be selectively directed by the gloved hands of the operator at the work W supported in the chamber 24, for example, directed at the housing of an automotive power steering pump requiring grit and grime and an oily film to be stripped off. The cleaning liquid runoff 158 along sloping path 154 carries with it the impact-dislodged grit and grime plus the solute therein from the clinging oil and dirt film dissolved by the liquid off the work W.

Splash and splatter of the extremely fast moving spray particles being stopped by the work W produce continuous mist from the cleaning liquid which, in a common portion of travel shared by the circulating liquid and air, transfers as a fog in a 1st crossover path 160 into entrainment in the chamber's circulating internal atmosphere.

Simultaneously, continuous agglomerate being recovered by the filter 136 is in part following the 2d crossover path 148 and in part following the 3d crossover path so that the two parts can combine and together be reunited with their parent stream of liquid runoff 158 at a floor pan juncture schematically appearing at 162. This common portion of travel shared by the circulating liquid and air makes possible the complete return for re-use of all cleaning liquid applied, and as one body it enters and pours down the drain line structure 86.

In the ordinary case, the continual stripping, by filtration, of the rising mist from the air almost as soon as it forms therein never allows the vapor concentration to run high enough for fogging over the operator's viewing window 40 in the console, not shown. However, problem cases can arise where a nonflammable hotter cleaning spray is desired as with a detergent-action cleaning powder in water, or where the cleaning liquid employed is some petroleum based solvent having, even without heating, an inherently high vapor pressure.

Further means of preventing the glass from steaming over from the water, misting, and other fogging are provided in the practice of my invention.

MODIFIED EMBODIMENT—FIGS. 8, 9

Illustrative of one such means is the modified embodiment of the invention as shown in these figures. Within the environment of the machine 20 already described and equipped with a floor stand 11, the modification occurring is made in respect of an electric blower **60*b* to enable the machine to perform with normal effectiveness even under the most stringent operating conditions of window fogging. In place of the run of air conduit forming a vertical tower as before, I provide a medially directed run of conduit 164 connected in the blower output extending in parallel closely adjacent to, and partway of, the chamber top wall structure 26 lengthwise. A horizontal window blower nozzle 166 is connected in the blower output communicatively transverse to the horizontal conduit 164 and laterally directed in its plane to impinge at an acute angle of incidence 168 beginning at a top inside portion of the window inset 40**.

The nozzle 166, formed with a long thin slot 170 in its discharge terminal, has outwardly flared sides 172 and 174, diverging in the direction of clear air flow toward the thin horizontal discharge slot so as to direct the latter, suitably diffused, in a thin, slot-wise widening blanket of forced scrubbing contact transverse to the window 40. The resulting diagonally downward path of lateral air flow is indicated by the direction arrows 176. The power control box 59 is shown in FIG. 9 with a vertical switch panel 178 at the front.

The agglomerate drip follows, as before, the 2d and 3d respective crossover paths 148 and 150.

For a console angle window setting of about 45° from the horizontal, the blown clean air path takes a forced turn likewise of 45° to follow the arrows 176. So under the impulse of the powerful blower motor 143 as herein provided, inertia of the moving air stream in resisting the turn creates an exaggerated impact spreading across the underside of the window 40 and forces it to be cleared off.

Although the scouring effect is akin to action expected from an automotive defogging and defrosting nozzle, the effect is more so here because the cleaning-liquid fog-removal in this instance changes the actual character of the air being blown; it is clear and is ridded of its fog contents. So the window surface is being dried by the scrubbing thereof with an undistorting, forced blanket of processed drying air, as well as being undistortedly air-curtained off from having a stagnant layer of foggy air settling in and misting up the underside.

CLEANING LIQUID

Cleaning liquids of a wide assortment are satisfactory for use in the present machine, and they commercially vary in composition according to the character of the industry in which they are utilized. In the bakery industry for example, a low sudsing solution of detergent in hot water under the strong spraying power hereof can readily scour off the baking pans.

When the reservoir of the machine is tanked with a petroleum based cleaning solvent for the oils and greases, the reservoir tank will sometimes be equipped with a thermostat with an appropriately low temperature setting for the heating coil, or more likely will have no heater or thermostat equipment at all. It is essential that the petroleum constituent have a high flash point, and 104° or a higher value such as 140° F. is not uncommon in the petroleum based solvents found in washers in the usual service and machine shops and repair garages. In many, the brand used currently and found altogether acceptable is Stoddard petroleum solvent produced by Safety-Kleen Company. Another highly suitable proprietary brand, made available through its distributors in many if not most states within the continental U.S.A. by one maker of assorted cleaning products, Graymills Corporation, Chicago, Ill., is its GM Super Agitene or GM Super Agitene 141 (FP 141° F.) safety solvents both of which are familiar to the trade.

Low bubbling soap/detergent solutions are preferred, particularly with the hot tank installations, and can be effectively applied by the machine to the different parts requiring washing in various shops or the like. A powder GM 571 alkaline cleaning detergent of Graymills in a water mixture heats stably to 180° F. and performs well in the machine, over an extremely wide range of cleaning applications.

Any of the effective liquids have the tendency under impetus of the high pressure impact to create a "wet" atmosphere, a problem even with petroleum based solvents at room temperature and surmounted herein. So positive internal air pressure cannot be allowed to develop because of the further complication of an escaping fume problem. The present machine never forces out fumes into the air; no pressure differential develops from inside and there is no net gain or loss in volume because all fluid taken from the hot tank returns to it and all air expelled by the blower is returned, eventually and without escape.

AIR FILTER

The specifications for the agglomerating filter are not rigid in the least; it works to full effectiveness as soon as all surfaces are wetted by the liquid and in one satisfactory working form it was simply a ¼" thick, 5" diameter closely knit pad of thin, chemically inert fibres. The film on the fully wetted surface areas thereof is continually fed by impacting fog particles, such as from the saturated steam of the usual water-mixes.

Fiberglas fibre is suitable for the knit pad material and so is zinc coated steel mesh, particularly when a petroleum solvent solution is being filtered out. For better efficiency the thickness can be increased to ½", and further satisfactory materials include foam rubber, paper filter material such as found in the air intake cleaner and silencer for automobiles, foam polyurethane material, and aluminum fine mesh.

OPERATION

The nature of the machine's operation is for cyclically repeated temporary intervals of spray cleaning of one object, thereafter to be exchanged for the next object to be cleaned.

As an example of the level of operating pressure I am referring to as a high pressure operation, the pump discharges at 1,100 psi in one generally satisfactory embodiment which has been built of the invention. In the main, pumps matched in capacity and outlet pressure to the nozzle to be employed would discharge in the broad range of 400 psi to 2,000 psi, whereas the preferred operating range for pressure delivered to the nozzle would be somewhere approximately from 400 psi to about 1,000 or 1,100 or 1,500 psi.

Because of the stripping effect of solvent herein under the stated discharge pressures, no pre-soaking and no brushing are ordinarily required. With the part in or at least manipulated by one gloved hand and the nozzle in the other, the operator exposes the interior and exterior surfaces of the part to direct force of the spray so as to dislodge the loose and clinging matter and dissolve deposited layers, films, and coats such as lubricant of which the part is to be ridded. The cleaning can be for metal chip removal, intricate passages, blind holes, tools and dies, and pneumatic and hydraulic cylinders.

Full force spraying will continue as long as the operator's foot presses the pedal 76.

In a reversal of all steps of the foregoing procedure, the operator releases the pedal, extricates his hands and forearms from the gloves, opens the door and, among other things, extricates the completely spray cleaned part. If a caged ball bearing happens to be the part and the selected cleaner a petroleum solvent, I insist in my own operations that additionally the part then be washed by hand in regular hot water and suds, rinsed off, and dried, such bearing for instance thus carrying with it no residual film of petroleum based solvent to interfere with the surfaces thereafter directly establishing intimate wetted contact with lubricant when being recoated with bearing grease for reinstallation.

The preferred practice of the operator in removing his hands and forearms, when in the work gloves extending into the machine, is lightly to grip the gloves' fingers, and withdraw the gloves conjointly for a distance. The outwardly flaring arms of the gloves thereupon convolute, allowing them to invert a portion of their larger diameter open ends. Afterwards, when the operator releases and removes his hands and wrists independently from the gloves, he then inherently by upswinging the door 30 overcenter to a diagonally rearward position folds the gloves at least partially out of the way of the access opening. FIG. 8 depicts a phantom showing of the left glove 52 as representative, with its telescopically inverted arm portion folded beneath the door 30 in the mutual storage position taken by the gloves. The glove fingers depend a distance below the door 30 and door opening, but only a short way because of the telescoped foreshortening of a substantial length of the glove 52.

A pump particularly well suited to the practice of this invention has not only the characteristic of delivering the referred to continuous high pressure to the spray nozzle, but equally the characteristic of delivering a continuous high rate of flow as compared to the usual low capacity pumps of hand washers for parts in general. A piston type electric pump developing $\frac{3}{4}$ hp under single phase 60 cycle current at 115 volts proves altogether adequate. Volume-wise, a pump capacity approximately between 2.2 and 3.5 gallons per minute continuously delivered under high pressure has proved satisfactory for the high rate, nozzle discharge velocities required herein. And it has been found here that that volume of spray flow can be altogether adequately supplied from a relatively moderately sized reservoir sometimes of 10 gallon capacity, but generally 5 gallons is of sufficient size.

CONTROL CIRCUITRY—FIG. 10

Power control apparatus is provided herein to coordinate the system of components appearing in this circuitry figure, comprising the schematically shown electric hot tank 80, electric pump 70, electric blower 60, and a source of electric power 180 grounded at the side 182 thereof.

For that purpose, a power line 184 is connected to the live side of the source 180 for energizing the control switches next enumerated which are seen to be included in the operating switching circuits. A relay switch 186 provided with an electrically operating relay coil 188 includes a set of normally closed contacts 190 electrically connected to power line 184 and connected in a load circuit 192 to the electric tank 80, and a set of transfer contacts 194 electrically connected to the power line and connected to the electric pump 70.

A control supply line 196 has circuit connections at one side connecting in respective first and second circuits 198, 200 each of the relay coil 188 and electric blower 60, and providing at the other side in respect of the coil and blower a common supply connection 202 therefor to the power line 184. A drive or so-called floor switch 204, physically located in the machine so as to be about two feet above floor level, not shown, is remotely operated pneumatically by the air capsule pedal 76; from the hollow interior which is closed at the top by a convoluted rubber diaphragm 206 on the pedal 76, the latter's capsule is connected by an air hose 208 to apply pressure or not in closing or opening the drive switch 204. Water on the floor such as mop water cannot short out the switch 204.

The switch 204 is connected electrically in series in the first circuit 198 for operating the relay coil 188 to limit the peak power demand of the system. The switch operates by, respectively in switch-closed position, deenergizing the electric tank 80 during cyclically repeated temporary intervals when the electric spray pump is operating under power, and otherwise deenergizing in switch-open position the electric pump 70 when the electrical supply resumes through the normally closed relay contacts 190 to the electric tank 80.

A blower switch 210, preferably closed by the operator before he starts applying the foot switch 204, is connected in the second circuit 200 so as to be electrically in series with the electric blower 60, with the intention that the latter will be energized at all times at which the electric pump is energized. A switch 212 on door 30, connected electrically in series in the common supply connection 202 for the relay and blower, acts as a door switch responsive to access door operation for automatic circuit interruption so as simultaneously to deenergize the electric blower and pump in a door-open switch-open relation and vice versa in the door-closed switch-closed relation.

The spray chamber light fixture 38 is connected in common with the sets of relay contacts 190, 194, so as to be electrically in parallel therewith to the power line 184. A main switch, shown at 214 in closed position, is connected electrically in series in the power line 184 so as, simultaneously when closed, to switch-on the chamber lights and, through the normally closed relay contacts 190, switch-on the electric tank for heating, and vice versa when open.

Finally, a thermostat switch 216 is connected electrically in series in the load circuit 192 to the electric tank 80 for limiting the peak electrical demand automatically in response to any hot cleaning liquid while at or above a predetermined cleaning temperature.

By inspection, it can be seen that when one step of operation acts in the circuits, another step forthwith reacts in its own operation. Thus concomitant with movement of closure of the operator's system initiating foot switch 204, the step brought about is that the upper relay contacts 190 automatically open interrupting further consumption of power in the load circuit 192, thus putting the electric tank 80 on standby. That is, the switch 204 is the second or last of the switches 212, 214 (circuit preparing switches) to close, thus to complete the lst or relay coil circuit.

Concomitant with this movement of opening the tank heater load circuit 192, the step brought about is that the lower relay contacts 194, always forced to act with but after in effecting their own response, automatically close the pump circuit allowing power to the electric pump 70 to be put on the line.

And always, concomitant with movement of opening the door 30, the step brought about is simultaneous interruption of power automatically in the two electric blower and pump circuits depressurizing the window blower and spray nozzles to keep from expelling any inside products to contaminate the outside.

And finally, concomitant with a sensed rise of tank temperature to the predetermined thermostat setting, the step brought about is automatically interrupting all power in the tank load circuit 192 thus limiting peak demand of power required in the other circuits of the system.

CIRCUITRY MODIFIED—FIG. 11

This modification in connecting up the control apparatus does not change the relation of components in the system bearing the same designations and reference numerals just considered, namely, machine 20, lamp fixture 38, blower 60, pump 70, spring-returned operating pedal 76, tank 80, power source 180 with ground 182 at the side, power line 184, safety switch 212 of the single throw, two-pole type, and the main switch 214 electrically in series in power line 184.

The foregoing switch 212 has its upper or first pole 203 interposed as normally closed connection completing the pump load connection 193 leading from transfer contacts 194 or transfer or pedal switch 187 to the pump 70. All the above switches are manual, with the latter 187 of them distinguished as double-throw, single pole.

Respective connections 185, 207, 196, and 206 connect the power line 184 and transfer switch 187, the operating pedal 76 and transfer switch 187, the power line 184 and electric blower 60, and the cabinet (24) and safety switch 212. By means of a connection 202 the lamp 38 is connected, in common with the second pole connection 205 of pedal switch 187 and electric blower 60, electrically in parallel therewith to the power line 184. A load circuit connection 192 from the normally closed poles or contacts 190 of pedal switch 187 connects through thermostat switch 216 to the tank heater 103.

FIG. 11 makes it clear that initial movement of closure of the switch first in series, the pedal switch l87, inherently opens the normally closed load circuit connection l92 of the heater 103 interrupting further consumption of power in the electric hot liquid tank 80. Yet the closure movement is concomitantly closing the pump load circuit 193 leading from transfer contacts 194 to spray pump 70, to spray the parts in the machine 20.

The window blower 60 meantime continues its running, having been initiated at outset of machine warmup conducted with the cabinet (22) closed and with the heater 103 and lamp 38 becoming energized at the time.

The counterpart action by the operator in alternating the operation of pump and heater circuits 193, l92 is for him to release pedal 76. Thus the nozzle (44) stops spraying parts and the tank heating resumes at 103.

During such regular operation, even under the condition that operating pedal 76 happens to be depressed at the time, initial manual opening of the cabinet (22) causes the snap blades of the safety switch 212 to drop open or spring open. So the circuitry is automatically disabled in the electric blower and pump circuits 196, 193, either preventing circulation through confinement of air and liquid or stopping an ongoing operation by depressurizing the window blower and spray nozzles (166, 44) of the spray chamber (24). But tank heating can still and desirably will transpire in load connection 192 through pedal switch 187.

The operator opens the main switch 214 for machine shut-down.

The resistance coil of the heater 103 for tank 80 nominally draws, in one physically constructed embodiment of the invention, 1,000 watts power on single phase, 115 volt, 60 Hz current, and is thus compatible with the already described electric pump in suitablity for a common 115 volt power source.

A resistor coil of the size just stated meets the requirement for a so-called fast heatup, bringing the 5 gallon tank from an ambient of 68° F. to the minimum spray temperature 120° F. in one hour. The temperature is somewhat flexible and, depending upon the solution used, is selectable in the approximate range from 120° to 180° F. The tank thermostat often selected can be expected to have a setting of about 140° F.

The nozzle requires pressure from the pump only intermittently, never as much as for a full minute. Off time, during any spray cycle, lasts about ten seconds to allow the operator to turn the part around or over to continue the spraying. The complete cycle per part, of all off and on times in the aggregate, will rarely last as long as five minutes. Thereafter, the pump stays idle to exchange parts.

It can be seen that, with the foregoing use of tank heating and nozzle pressurization occurring only at short, always spaced apart intervals, and under water solution requirements, there is no problem to the liquid heater for steady temperature maintenance in the tank.

While in practice the electric pump 70 will draw 11 or 12 amperes, surging up to about 17 perhaps in a momentary hardly perceptible spike, and the heater coil will draw 12 to 13 amperes, the usual shop circuits providing 115 volts are easily accommodated to; the latter are breakered or fused for 15 or 20 amperes and so are never overloaded by the present machine, which thus offers universal adaptability and application and installation with no need for higher voltage outlets or special wiring.

Variations within the spirit and scope of the invention described are equally comprehended by the foregoing description.

What is claimed is:

1. Cleaning process with an internally recirculating spray chamber machine self-contained in its operation by a cabinet having a blower window at the front side, said spray chamber machine having a window nozzle supplied under pressure by air circulating means and a cleaning spray nozzle supplied with re-used liquid both under pressure and heated by cleaning liquid circulating means, a heater operative in the liquid circulating means to warm up and keep the liquid up to heat, a lamp behind the window in the cabinet operative to keep the chamber illuminated, said air if unprocessed tending to blow and impinge moisture onto the blower window, said cabinet which effects an open-condition at the front side being normally closeable in the lateral escape paths of out-blowing of the window nozzle and of overspray of the cleaning spray nozzle, comprising the steps of:

rendering at the outset at least the lamp and heater effectively operative for proper machine warmup;

utilizing the nozzles, as rendered in operable status, by pressurizing same initiating the eventual cleaning process with the cabinet closed;

opening the cabinet of the machine having the defined normal position closeable in the lateral escape paths of out-blowing of the window nozzle and overspray of the spray nozzle;

holding the chamber and liquid substantially up to heat with the heater and lamp effective as in warmup; and automatically, in response to a sensed open condition of the cabinet, disabling the nozzles from their operable status through confinement of the circulated air and liquid by preventing circulating entirely.

2. Cleaning process with an internally recirculating spray chamber machine self-contained by a front windowed cabinet in its operation, said spray chamber machine having a front window blower nozzle supplied under pressure by air circulating means and a cleaning spray nozzle supplied with re-used liquid under pressure by cleaning liquid circulating means, said air if unprocessed tending to blow and impinge moisture onto the blower window, said cabinet which effects an open-condition at the front side being normally closeable in the lateral escape paths of out-blowing of the window blower nozzle and of overspray of the cleaning spray nozzle, comprising the steps of:

utilizing the nozzles, as rendered in operative status, by pressurizing same initiating the cleaning process with the cabinet closed;

processing, so as to render it clear, all air circulated in the spray chamber machine, with the cabinet closed, and re-using and retaining all processed air internally;

processing, so as to render it clean, all liquid circulated through the spray chamber machine, with the cabinet closed, and re-using and retaining all processed liquid internally of the spray chamber machine;

opening the cabinet of the machine having the defined normal position closeable in the lateral escape paths of out-blowing of the blower nozzle and overspray of the spray nozzle; and automatically, in response to a sensed open condition of the cabinet, disabling the nozzles from their operative status through confinement of the circulated air and liquid by preventing circulation entirely.

3. In a process of operating a hot tank spray washer which comprises a closeable pump circuit including a liquid-supplied electric pump therein having a liquid output and a spray cleaning nozzle in the output, a normally closed heater circuit including an electric hot liquid tank therein for supplying the electric pump, power means for operating the pump and heater circuits in alternation comprising a circuit including at least two control switch means which are in series connection and of which the first in order in the series closes last and is closeable by operator-operation, a normally power-sustained load circuit leading from the second switch including an electric blower having a clear air output which provides a window blower nozzle pressurized for generally sustaining a blanket of clear air, and a blown-window spray chamber which houses the window blower and spray cleaning nozzles and which from a cabinet-open condition can be closed over the direct and offshoot paths of the nozzles to confine all blowing and overspray to the chamber, the multiple steps to the process which comprise:

a step, occurring concomitant with movement of closure of the first switch, of automatically opening the normally closed heater circuit interrupting further consumption of power in the electric hot liquid tank;

a step, occurring concomitant with movement of opening the heater circuit, of automatically closing the pump circuit with the ensuing first switch closure to pressurize the spray nozzle; and a step, concomitant with movement of opening the cabinet, of automatically interrupting further consumption of power in the electric blower and pump circuits, depressurizing the window blower and spray nozzles.

4. In a process of operating a hot tank spray washer which comprises a closeable pump circuit including a liquid-supplied electric pump therein having a liquid output and a spray cleaning nozzle in the output, a normally closed heater circuit including an electric hot liquid tank therein for supplying the electric pump, power means for operating the pump and heater circuits in alternation comprising a circuit including a relay coil and at least two control switch means which are in series connection thereto and of which there is at least a second switch closing last in the relay coil circuit and closeable by operator-operation, a normally power-sustained load circuit including an electric blower having a clear air output which provides a window blower nozzle pressurized for generally sustaining a blanket of the clear air, and a blown-window spray chamber for housing the window blower and spray cleaning nozzles having an access door closeable in the direct and offshoot paths of the nozzles to confine all blowing and overspray to the chamber, the multiple steps to the process which comprise:

a step, occurring concomitant with movement of closure of the second switch of the two switch means to the relay coil, of automatically opening the normally closed heater circuit interrupting further comsumption of power in the electric hot liquid tank;

a step, occurring concomitant with movement of opening the heater circuit, of automatically closing the pump circuit to pressurize the spray nozzle; and a step, concomitant with movement of opening of the access door, of automatically interrupting further consumption of power in the electric blower and pump circuits, depressurizing the window blower and spray nozzles.

5. The process as set forth in claim 4, which further comprises:

a step, occurring concomitant with a sensed rise of tank temperature to a predetermined thermostatic setting, of automatically opening the heater circuit interrupting further consumption of power in the electric tank.

6. In a process of operating a hot tank spray washer which comprises a closeable pump circuit including a liquid-supplied electric pump therein having a liquid output and a spray cleaning nozzle in the output, a normally closed heater circuit including an electric hot liquid tank therein for supplying the electric pump, power means for operating the pump and heater circuits in alternation comprising a circuit including a relay coil and at least two control switch means which are in series connection thereto and of which there is at least a second switch closing last in the relay coil circuit and closeable by operator-operation, a normally power-sustained load circuit including an electric blower having a clear air output which provides a window blower nozzle pressurized for generally sustaining a blanket of clear air, and a blown-window spray chamber for housing the window blower and spray cleaning nozzles having an access door closeable in the direct and offshoot paths of the nozzles to confine all blowing and overspray to the chamber, the multiple steps to the process which comprise:

a step, occurring concomitant with movement of closure of the second switch of the two switch means to the relay coil, of automatically opening the normally closed heater circuit interrupting further consumption of power in the electric hot liquid tank;

a step, occurring concomitant with movement of opening the heater circuit, of automatically closing the pump circuit to pressurize the spray nozzle;

spraying a part with the nozzle pressurized and then de-pressurizing to discontinue the spraying with the pump circuit respectively closed and open-circuited; and a step, concomitant with movement of opening of the access door, of automatically interrupting all further use of power in the electric blower and pump circuits and restoring heating in the electric hot liquid tank by returning the heater circuit to normally closed condition.

7. In a process of operating a hot tank spray washer which comprises a closeable pump circuit including a liquid-supplied electric pump therein having a liquid output and a spray cleaning nozzle in the output, a normally closed heater circuit including an electric hot liquid tank therein for supplying the electric pump, power means for operating the pump and heater circuits in alternation comprising a circuit including a relay coil and two control switch means in series connection thereto comprising first and second switches, a power load circuit including an electric blower and a third switch in series connection therewith to control the electric blower, said second and third switches individually closeable by operator-operation, said electric blower having a clear air output which provides a window blower nozzle for delivery of a blanket of the clear air, and a windowed spray chamber for housing the window blower and spray nozzles having an access door closeable in the path of the nozzles to confine all blowing and overspray to the chamber, the multiple steps to the process which comprise:

a step, occurring concomitant with movement of closure of the third switch, of automatically closing the first of the two switches in series connection to the relay coil, said operator-closed third switch energizing the electric blower with power to pressurize the window blower nozzle;

a step, occurring concomitant with movement of closure of the second of the two switches to the relay coil, of automatically opening the heater circuit interrupting further consumption of power in the electric hot liquid tank;

a step, concomitant with movement of opening of the heater circuit, of automatically closing the pump circuit to pressurize the spray nozzle; and a step, concomitant with movement of opening of the door, of automatically interrupting further consumption of power in the electric blower and electric pump circuits, depressurizing the window lower and spray nozzles.

8. Control apparatus for an internally recirculating spray chamber machine self-contained by a front windowed cabinet which opens at its front side, said spray chamber machine having a supply tank equipped with electric heater and an electric spray pump supplied thereby to provide hot cleaning liquid for spray washing of which a characteristic is a rising fog in the spray chamber, an electric blower with input in which a fog separator is provided and with an output which provides a defogging nozzle connected therein in an operative relation of blanketing the cabinet window with recycled air cleared of fog, and an electric power cource, comprising:

a power line for connection to the power source, and control switch means including operating switching circuits;

a transfer switch included in the operating switching circuits with normally closed contacts and with transfer contacts;

a connection to the power line and to the transfer switch, and a load connection to the normally closed contacts of the latter and to the electric tank heater;

an operating pedal;

a connection to the operating pedal and to the transfer switch to operate the latter;

a single throw, multipole safety switch providing at least first and second pole connections, with the first connection a load connection to the transfer switch transfer contacts and to the electric spray pump and the second connection to the power line and to the electric blower; and a connection to the cabinet and to the safety switch to operate the latter simultaneously deenergizing the electric blower and electric spray pump in a cabinet-open open-throw switch relation and vice versa in the normal cabinet-closed switch-closed relation.

9. The invention according to claim 8 characterized by:

a spray chamber lamp connected, in common with the second pole connection and electric blower, electrically in parallel therewith to the power line; and a main switch included in the operating switching circuits and connected electrically in series in said power line, and respectively closing and opening so as, simultaneously when closed, to switch-on the chamber lamp and, through the respective normally closed contacts and pole connection of the relevant switches, switch-on the electric tank heater and electric blower, and vice versa when open.

10. Cleaning process with an internally recirculating spray chamber machine self-contained in its operation by a cabinet having at the front side a viewing window having motor-operated window clearing means therebehind, said spray chamber machine having a cleaning spray nozzle supplied with re-used detergent water solution under pressure and heated by cleaning liquid circulating means, a heater operative in the liquid circulating means to warm up and keep the detergent solution up to heat, said window having also therebehind a lamp connected at a point to the cabinet operative to keep the chamber internally illuminated, said cabinet which effects an open-condition at the front side being normally closeable in the lateral escape path of overspray of the cleaning spray nozzle, comprising the steps of:

rendering at outset at least the lamp and heater effectively operative for proper machine warmup;

utilizing the spray nozzle, as rendered in operable status, by pressurizing same initiating the eventual cleaning process with the cabinet closed;

opening the cabinet of the machine having the defined normal position closeable in the lateral escape path of overspray of the spray nozzle;

holding the chamber and detergent solution substantially up to heat with the heater and lamp effective as in machine warmup; and automatically, in response to sensed open-condition effected by the cabinet, disabling the spray nozzle from its operable status through confinement of the circulated detergent solution by preventing circulation entirely.

11. Parts cleaning process with an electrically powered spray chamber machine, which machine is self-contained in its operation by a cabinet provided at the front side with a viewing window having motor-driven window clearing means therebehind, which machine having a nozzle circuit the nozzle of which is supplied with detergent washing solution under pressure and heated by cleaning liquid circulating means electrically included in the circuit, said circuit prepared at a point to ready the nozzle to be operated, and a heater connected to the liquid circulating means, operative to warm up and sustain the detergent washing solution at washing temperature and connected in a heater load circuit, said machine providing energizing circuitry connected so as, in one alternative mode or in the other, to supply the nozzle circuit for spraying and otherwise connected in circuit to supply the load circuit to the heater, said cabinet which effects an open-condition at the front side being normally closeable in the lateral escape path of overspray of the nozzle, comprising the steps of:

rendering at outset at least the heater effectively operative for proper machine warmup; then, in the alternative mode:

utilizing the nozzle, as rendered in operable status, by pressurizing same initiating the eventual parts' cleaning with the cabinet closed; and, in the eventuality of both:

a sensed open-condition effected by the cabinet and foot-release at a switch-opening point to open-circuit the nozzle circuit as prepared, automatically disabling the still prepared nozzle circuit at the prepared point aforesaid and reconnecting in circuit the load circuit to the heater to sustain washing temperature during parts' exchange.

* * * * *